US006799545B2

(12) United States Patent
Shaw

(10) Patent No.: US 6,799,545 B2
(45) Date of Patent: Oct. 5, 2004

(54) CARBURETOR START PUMP CIRCUIT

(75) Inventor: Scott R Shaw, Nashville, TN (US)

(73) Assignee: Zama Japan (JP)

( * ) Notice: Subject to any disclaimer, the term of this patent is extended or adjusted under 35 U.S.C. 154(b) by 0 days.

(21) Appl. No.: 10/162,458

(22) Filed: Jun. 3, 2002

(65) Prior Publication Data

US 2003/0221650 A1 Dec. 4, 2003

(51) Int. Cl.[7] ..... F02M 1/16

(52) U.S. Cl. ..... 123/179.11; 123/179.14; 261/35

(58) Field of Search ..... 123/179.7, 179.12, 123/179.13, 179.14, 179.15, 179.11, DIG. 5; 261/35

(56) References Cited

U.S. PATENT DOCUMENTS

| | | | | |
|---|---|---|---|---|
| 3,743,254 A | | 7/1973 | Tuckey | 261/35 |
| 4,159,012 A | | 6/1979 | Pizzuto et al. | 261/35 |
| 4,554,896 A | | 11/1985 | Sougawa | 123/179.15 |
| 4,814,114 A | | 3/1989 | Charmley | 261/35 |
| 4,903,655 A | * | 2/1990 | Vonderau et al. | 261/35 |
| 5,150,673 A | | 9/1992 | Hoshiba et al. | 123/179.15 |
| 5,706,774 A | * | 1/1998 | Shaw | 123/179.14 |

* cited by examiner

*Primary Examiner*—Mahmoud Gimie
*Assistant Examiner*—Arnold Castro
(74) *Attorney, Agent, or Firm*—Orrick, Herrington & Sutcliffe LLP

(57) ABSTRACT

A carburetor start pump circuit, for starting an engine has an auxiliary fuel pump mounted on a relatively standard carburetor body, a start pulse passage extending through the carburetor body to the auxiliary fuel pump, and a fuel circuit having an intake side which extends from a metering chamber of the carburetor body to the auxiliary fuel pump and a discharge side which is interconnected to the intake side and extends from the auxiliary fuel pump to a throttle bore in the air intake of the carburetor body. To prevent the engine from stalling, a restriction jet is placed within the start pulse passage to prevent the auxiliary fuel pump from discharging fuel into the throttling bore when the engine transmits pulses at high frequencies.

39 Claims, 2 Drawing Sheets

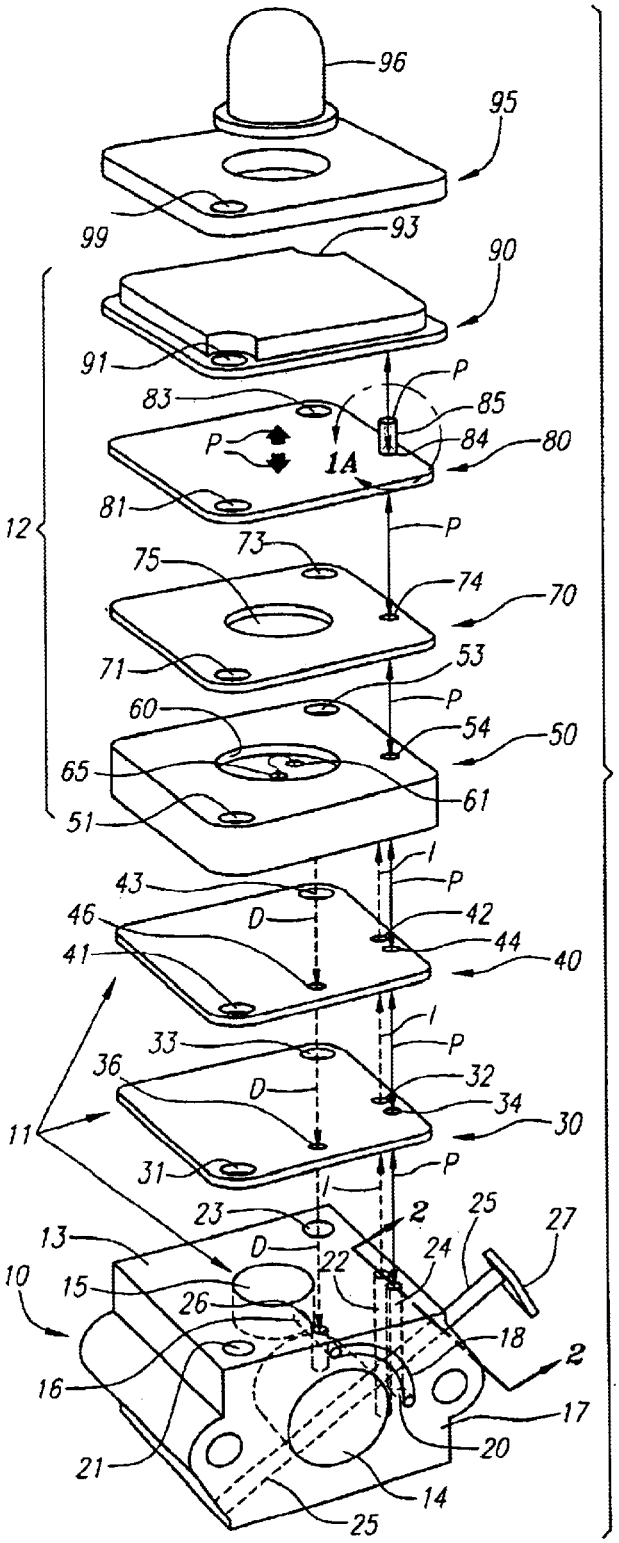
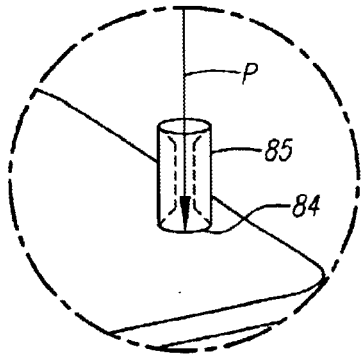
FIG. 1A
FIG. 1
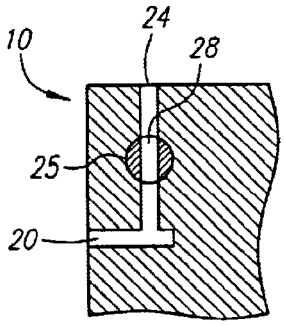
FIG. 2

CARBURETOR START PUMP CIRCUIT

FIELD OF THE INVENTION

This invention relates to carburetors, and more particularly to an air-fuel mixture enrichment circuit that facilitates engine starting.

BACKGROUND OF THE INVENTION

Most engines require a mixture enrichment system to improve or even allow starting. An enrichment system is especially necessary when the engine is cold, or after the engine has been run out of fuel. The two common means of enrichment in the field of small engines are the choke and the primer.

The choke provides enrichment by closing off the front end of the air intake of a carburetor to allow a manifold vacuum to draw on all of the fuel passages that open to the air intake. The disadvantage of the choke is that the user must close the choke completely and then crank the engine until they hear a false start. The choke is then partially opened and the engine is cranked until it starts. When the engine is warmed up 30 to 40 seconds, the choke is opened fully. This operation is too complex for many users and results in many field returns and complaints.

The primer uses a manually operated bulb to inject fuel into the carburetor throat. The disadvantage of the primer is that a simple primer cannot regulate the amount of fuel injected into the carburetor throat which makes it easy for the user to over- or under-prime the engine, resulting in no start.

An improved enrichment system uses an auxiliary fuel pump coupled with the carburetor body. The auxiliary fuel pump provides enrichment by injecting fuel into the carburetor throat when starting the engine. To prevent over- or under-priming the engine, the auxiliary fuel pump uses a pulse emitted from the engine's crankcase to control the fuel injection. This approach is described in more detail in U.S. Pat. No. 5,706,774, entitled "Carburetor Start Pump Circuit," filed on May 24, 1996, which is hereby incorporated by reference in its entirety.

When using a system such as the auxiliary fuel pump described above, it may be desirable to deactivate the system when the engine warms up because a constant fuel-air ratio will have been obtained, and thus, there would be no need for additional fuel injection. However, often times, the user may forget to do so or may engage the system when the engine is already running and is warmed up or hot. This may result in the engine "conking out" or stalling due to too much fuel being injected into the carburetor throat while the engine is running.

Therefore, it is believed that an improved carburetor start pump circuit would be desirable.

SUMMARY OF THE INVENTION

The carburetor start pump circuit of the present invention serves to facilitate engine starting in a simple manner that is independent of manifold vacuums and capable of regulating the amount of fuel injected into the carburetor throat to ensure the engine is properly primed. It preferably has an auxiliary fuel pump mounted on a relatively standard carburetor body, a start pulse passage extending through the carburetor body to the auxiliary fuel pump, and a fuel circuit having an intake side which extends from a metering chamber of the carburetor body to the auxiliary fuel pump and a discharge side which is interconnected to the intake side and extends from the auxiliary fuel pump to a throttle bore in the air intake of the carburetor body. To prevent the engine from stalling, a restriction jet is placed within the start pulse passage to limit the amount of fuel that the auxiliary pump may discharge into the throttling bore when the engine transmits pulses at high frequencies.

An object of this invention is to provide an improved carburetor start pump circuit.

Further, objects and advantages of the invention will become apparent from the following detailed description and accompanying drawings.

BRIEF DESCRIPTION OF THE DRAWINGS

FIG. 1 is an exploded isometric view of a preferred embodiment of a carburetor including the start pump circuit of the present invention.

FIG. 1A is a partial detailed view taken along line 1A in FIG. 1.

FIG. 2 is a partial cross-sectional view taken along line 2—2 in FIG. 1.

DETAILED DESCRIPTION OF THE PREFERRED EMBODIMENTS

Figure 3:
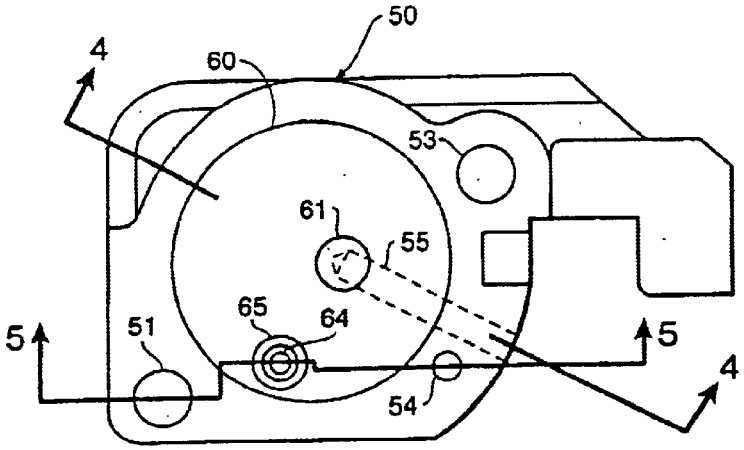
FIG. 3 is a top view of an auxiliary start pump body of the carburetor start pump circuit of the present invention.

Referring now in detail to the drawings, therein illustrated is a novel carburetor start pump circuit of the present invention. Turning to FIG. 1, a relatively standard carburetor body 10 includes a main pulse passageway 16 bored into the carburetor body 10 from its face 17. The main pulse passageway 16 opens into a pulse chamber 15 of a main fuel pump 11 bored into the carburetor body 10 from a top surface 13. A starting pulse passageway 20 is also bored into the carburetor body 10 from the face 17. A channel 18, preferably two millimeters wide, is cut into the face 17 of the carburetor body 10. The channel 18 runs from the main pulse passageway 16 to the starting pulse passageway 20 to carry the crankcase pulse to the starting pulse passageway 20. The channel 18 is interconnected to the crank case of an engine at a point adjacent to the main pulse passageway 16. The remainder of the channel 18 is covered by a carburetor mounting gasket (not shown) which interposes the carburetor body 12 and the engine (not shown) when the carburetor is mounted on the engine.

Three passageways are bored into the carburetor body 10 from the top surface 13. The first is a pulse passageway 24 which opens into the starting pulse passageway 20. The second is a fuel intake passageway 22 which opens into the metering chamber (not shown) of the carburetor body 10. The third is a fuel discharge passageway 26 which opens into a throttle bore 14 of the air intake of the carburetor body 10.

Referring to FIGS. 1 and 2, the pulse passageway 24 is shown to be operably interconnected to the starting pulse passageway 20 via a passageway 28 drilled through a throttle shaft 25. Thus, passageways 20 and 24 are only in communication with one another when a throttle lever 27 attached to the throttle shaft 25 is positioned in a start position which results in passageway 28 being aligned with passageways 20 and 24.

Turning to FIG. 1, a pair of holes 21 and 23 are tapped into the top surface 13 of the carburetor body 10 and used to mount a main fuel pump 11 and an auxiliary or start fuel pump 12. The main fuel pump 11, which operates in a manner known in the art, includes a flat fuel pump diaphragm 30 mounted on the top surface 13 of the carburetor body 10. The diaphragm 30 interposes the carburetor body 10 and a fuel pump gasket 40. The fuel pump diaphragm 30 includes a pair of holes 31 and 33 that are aligned with holes 21 and 23 in the carburetor body 10 to mount the diaphragm 30 on the carburetor body 10. In addition, the fuel pump diaphragm 30 includes a fuel intake hole 32, a pulse hole 34, and a fuel discharge hole 36. The fuel intake hole 32, the pulse hole 34, and the fuel discharge hole 36, respectively, are aligned with the fuel intake passageway 22, the pulse passageway 24, and the fuel discharge passageway 26, respectively, in the carburetor body 10 when the fuel pump diaphragm 30 is mounted on the top surface 13 of the carburetor body 10.

The fuel pump gasket 40, which mounts on the carburetor body 10 on top of the fuel pump diaphragm 30, also includes a pair of holes 41 and 43 that are aligned with holes 21 and 23 in the carburetor body 10 to mount the gasket 40. The fuel pump gasket 40 also includes a fuel intake hole 42, a pulse hole 44, and a fuel discharge hole 46, respectively, that are aligned with the fuel intake passageway 22, the pulse passageway 24, and the fuel discharge passageway 26, respectively, in the carburetor body 10 when the fuel pump gasket 40 is mounted on the carburetor body 10.

The auxiliary fuel pump 12 includes a pump body 50 mounted on top of the main fuel pump 11, a start pump gasket 70 mounted on top of the start pump body 50, a start pump diaphragm 80 mounted on top of the start pump gasket 70 and a start pump cover 90 mounted on top of the start pump diaphragm 80. Holes 51 and 53 in the start pump body 52, holes 71 and 73 in the start pump gasket 70, holes 81 and 83 in the start pump diaphragm 80, and holes 91 and 93 in the start pump cover 90 are all aligned with the holes 21 and 23 in the carburetor body 10 to mount these components on the carburetor body 10.

Figure 4:
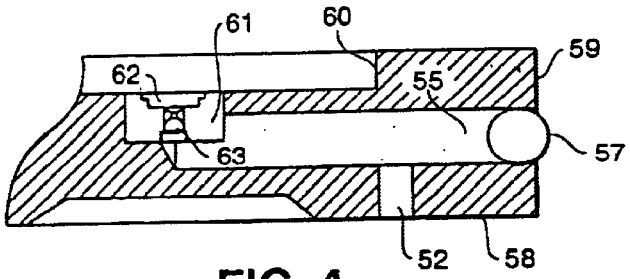
FIG. 4 is a partial cross-sectional view taken along line 4—4 in FIG. 3.
Figure 5:
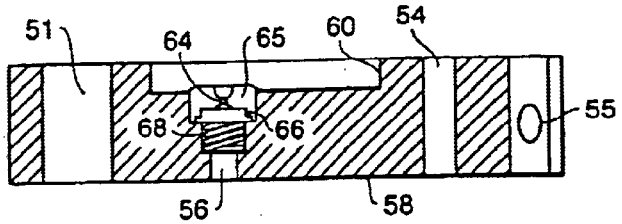
FIG. 5 is a cross-sectional view taken along line 5—5 in FIG. 3.

The auxiliary pump body 50 as shown in FIGS. 1, 3, 4 and 5 includes a fuel intake passage 52 bored into the fuel pump body 50 from its bottom surface 58. The fuel intake passageway 52 opens into an intake pathway 55 bored into the auxiliary pump body 50 from its side 59. A plug 57 seals one end of the intake pathway 55 adjacent to the side 59 of the pump body 52. The intake pathway 55 directs the fuel from the metering chamber to an inlet check valve 62 seated in an inlet valve chamber 61. The inlet check valve 62 is a simple viton disk that allows fuel to flow into a pumping chamber 60 bored into the auxiliary pump body 50 from its top surface 67, but prevents back flow. The inlet valve chamber 61 is bored into the auxiliary pump body 50 from the pump chamber 60. A calibrated inlet jet 63 may be positioned at the entrance of the inlet check valve 62 to meter the flow of fuel into the pumping chamber 60.

The auxiliary pump body 50 also includes a pulse passageway 54 bored through the auxiliary pump body 50 and a fuel discharge passageway 56 bored into the auxiliary pump body 50 from its bottom surface 58. The pulse passageway 54 is aligned with the pulse passageway 24 in the carburetor body 10 and the fuel discharge passageway 56 is aligned with the fuel discharge passageway 26 in the carburetor body 10. The fuel discharge passageway 56 opens to a discharge check valve chamber 65 bored into the auxiliary pump body 50 from the pumping chamber 60. A discharge check valve 66 is mounted in the valve chamber 65. The discharge check valve 66 is held close against its seat by a spring 68 positioned on the discharge side of the check valve 66. The spring force prevents fuel from being drawn out of the system by the carburetor manifold vacuum when the start pump 12 is shut off, i.e., when the throttle shaft 25 is rotated out of the start position and passageway 28 is no longer aligned with passageways 20 and 24. A calibrated jet 64 may be positioned on the inlet side of the discharge check valve 66. The calibrated jets 63 and 64 restrict the fuel flow into the engine to prevent an overrich condition at startup.

The auxiliary pump gasket 70 maintains a seal between the auxiliary pump body 50 and the auxiliary pump diaphragm 80. The gasket 70 includes a pulse hole 74 aligned with the pulse passageway 24 in the carburetor body 10 and a hole 75 aligned with the pumping chamber 60 in the auxiliary pump body 50 to allow the auxiliary pump diaphragm 80 to communicate with the pumping chamber 60.

The auxiliary pump diaphragm 80 transfers the force of the crank case pulse to the fuel in the pumping chamber 60 of the auxiliary pump body 50. The flat auxiliary pump diaphragm 80 includes a pulse hole 84 aligned with the pulse passageway 24 in the carburetor body 10.

The pump cover 90, which seals the stack of gaskets 40 and 70, diaphragms 30 and 80, and the auxiliary pump body 52, accepts the crank case pulse P and directs it to the auxiliary pump diaphragm 80.

In operation, the start pump 10 is activated by turning on the crank case pulse supplied to it. The crank case pulse P can be controlled with the throttle shaft as shown in FIG. 1, or by some other means such as a choke shaft or some other valve. The preferred embodiment as shown in FIGS. 1 and 2 includes a hole 28 drilled through the throttle shaft 25. When the throttle shaft 25 is rotated past wide open throttle to a preset position, the hole 28 in the throttle shaft 25 aligns with passageways 20 and 24 in the carburetor body 10 and the pulse P is allowed to enter the start pump 12. This control configuration ensures that the start pump 12 only feeds fuel to the engine during start-up.

The pulse P travels up through the stack of the main fuel pump diaphragm 30 and the main fuel pump gasket 40, and then through the auxiliary pump body 52, diaphragm 80, and gasket 70 and on into the start pump cover 90. The pulse P moves the diaphragm 80 up and down which creates a corresponding vacuum and pressure in the pumping chamber 60 of the auxiliary pump body 50. The vacuum pulse opens the inlet check valve 62 and draws fuel I from the metering chamber (not shown) of the carburetor body 10. By drawing fuel from the metering chamber, the carburetor start pump circuit advantageously acts as an air purge or primer.

The fuel I passes through the carburetor body 10 through the main fuel pump diaphragm 30 and gasket 40, into the start pump body 50 and on into the pumping chamber 60 through the inlet check valve 62 and, optionally, through the calibrated metering jet 63. When the auxiliary pump diaphragm 80 is pushed down into the auxiliary pump body 50 by the crank case pulse P, the inlet check valve 62 is forced closed and the force of the crank case pulse P is transferred to the fuel forcing the fuel through the discharge check valve 66 and, optionally, first through the calibrated metering jet 64. The fuel must pass through the starting jet 64 and press open the spring 68 loaded check valve 66 to leave the pumping chamber 60. The spring 68 exerts a sufficient force on the check valve 66 to prevent it from being opened by a manifold vacuum and thus ensuring that fuel is not drawn through the carburetor start pump circuit unless the start pump 12 is receiving a pulse P.

The fuel D then exits the auxiliary pump body 50 through the discharge fuel passageway 56 and passes back through the main pump gasket 40 and diaphragm 30, and on through the fuel discharge passageway 26 into the throttle bore 14 in the carburetor body 10. When the engine is warmed up, the operator shuts off the start pump circuit and the engine begins normal operation.

As mentioned above, often times the operator may neglect to shut off the start pump circuit when the engine is warmed up or accidentally engage the start pump when the engine is already operating and warmed up. This may result in the engine stalling or "conking out" from too much fuel being discharged into the throttling bore 14. One approach to prevent the engine from stalling is to place a calibrated restriction or jet 85 anywhere along the path that the start pulse P travels, and preferably somewhere between the carburetor body 10 and the start pump cover 90 of the auxiliary fuel pump 12. As shown in FIG. 1A, the jet 85 is placed in the pulse hole 84 of the start pump diaphragm 80.

The jet 85 is positioned and calibrated such that the jet 85 tends to substantially choke off high frequency pulses P transmitted from the engine, thus substantially choking off the power to move the start pump diaphragm 80 at the high frequencies. In other words, when the engine starts to warm up, the jet 85 tends to substantially reduce the amount of fuel D that the auxiliary fuel pump 12 discharges into the throttling bore 24.

When the engine is being cranked, a low frequency pulse P, e.g., about 18 hz or about 800 rpm, is transmitted from the engine. At the lower frequency, a substantial portion of the pulse P will pass through the jet 85 sufficient to operate the start pump diaphragm 80. When the engine starts to warm up, it starts to supply a higher frequency pulse P, e.g., about 80 hz or about 5000 rpm. At this point, the engine will no longer need mixture enrichment. The jet 85 tends to choke off a substantial amount of the pulse P transmission to the start pump circuit sufficient to substantially decrease the operation of the start pump diaphragm 80. Thus, the start pump circuit will advantageously cease operation or at least substantially limit the amount of fuel D discharged into the throttling bore 24, preventing the engine from conking out or stalling.

In an alternative embodiment (see FIG. 1), the carburetor start pump circuit of the present invention would include a primer having a pump body 95 and a primer bulb 96. The primer is mounted to the carburetor body using a pair of holes 95 and operates in a manner known in the art.

Thus, the carburetor start pump circuit of the present invention provides many benefits over the prior art. While the above description contains many specificities, these should not be construed as limitations on the scope of the invention, but rather as an exemplification of one preferred embodiment thereof. Many other variations are possible.

Accordingly, the scope of the present invention should be determined not by the embodiments illustrated above, but by the appended claims and their legal equivalents.

What is claimed is:

1. A carburetor, comprising:

a body;

a first fuel pump mounted on the body; and a starter circuit including a second fuel pump mounted on the body, a first pulse passageway, having a beginning and an end, extending through the body to the second fuel pump, and a restriction within the first pulse passageway.

2. The carburetor in claim 1, wherein the restriction is calibrated such that the restriction substantially chokes off high frequency pulses.

3. The carburetor in claim 1, wherein the restriction chokes off high frequency pulses sufficient to prevent the second fuel pump from operating, and further wherein the restriction passes through low frequency pulses sufficient to operate the second fuel pump.

4. The carburetor in claim 1, wherein the restriction is a jet.

5. The carburetor in claim 1, wherein the restriction is in the beginning of the first pulse passageway.

6. The carburetor in claim 1, wherein the restriction is in the end of the first pulse passageway.

7. The carburetor of claim 1, wherein the second fuel pump is only operational during engine start-up.

8. The carburetor of claim 1, wherein the starter circuit further includes a first fuel passageway interconnecting the second fuel pump to a metering chamber in the body; and a second fuel passageway interconnecting the second fuel pump to a throttle bore in the body.

9. The carburetor of claim 8, wherein the starter circuit further includes an inlet check valve interposing the first fuel passageway and a pumping chamber in the second fuel pump.

10. The carburetor of claim 8, wherein the starter circuit further includes an outlet check valve interposing the second fuel passageway and a pumping chamber in the second fuel pump.

11. The carburetor of claim 10, wherein the outlet check valve is spring loaded.

12. The carburetor of claim 1, wherein the starter circuit further includes a metering jet.

13. The carburetor in claim 1, further comprising a second pulse passageway extending through the body to the first fuel pump; and a channel interconnecting the first and second pulse passageways.

14. The carburetor of claim 1, wherein the second fuel pump includes a diaphragm.

15. The carburetor of claim 1 wherein the first pulse passageway has an open mode during engine start-up and a closed mode during all other modes of engine operation.

16. The carburetor of claim 1 further comprising a primer bulb interconnected to the second fuel pump.

17. A carburetor comprising a body; and a start circuit including a fuel pump mounted on the body and driven by a pulse from an engine's crankcase during start-up of an engine, a pulse passageway extending through the body to the fuel pump, a first fuel passageway operably interconnecting the fuel pump to a metering chamber in the body, a second fuel passageway operably interconnecting the fuel pump to a throttle bore in the body, and a restriction jet within the pulse passageway.

18. The carburetor in claim 17, wherein the restriction jet is positioned and calibrated such that the restriction jet substantially limits the pulse from the engine's crankcase to the fuel pump at high frequencies.

19. The carburetor of claim 17, further comprising a second fuel pump mounted on the body.

20. The carburetor of claim 17, further comprising a second pulse passageway extending through the body to the second fuel pump.

21. The carburetor of claim 17, wherein the pulse passageway is interconnected to the second pulse passageway.

22. A carburetor comprising:

a body;

a first fuel pump mounted on the body;

a second fuel pump mounted on the body, the second fuel pump being operably interconnected to an engine's crankcase during engine start-up when the body is mounted to an engine; and a means for limiting the interconnection between the second fuel pump and the engine's crankcase when the engine warms up.

23. The carburetor of claim 22, further comprising a pulse passageway extending through the body to the second fuel pump.

24. The carburetor in claim 23, wherein the means for limiting the interconnection is a restriction jet within the pulse passageway.

25. The carburetor in claim 23, wherein the pulse passageway extends from the body to the second fuel pump.

26. The carburetor in claim 23, wherein the pulse passageway includes a valve member mounted in the pulse passageway.

27. The carburetor of claim 26 wherein the valve member is positionable to a preset engine start-up position wherein the pulse passageway is open.

28. The carburetor of claim 27 wherein the valve member comprises a throttle valve shaft having a hole drilled therethrough, the hole being aligned with the pulse passageway when the throttle valve shaft is rotated to a preset engine start-up position.

29. The carburetor of claim 28 further comprising a first fuel passageway operably interconnecting the second fuel pump to a metering chamber in the body, and a second fuel passageway operably interconnecting the second fuel pump to a throttle bore in the body.

30. A carburetor, comprising:

a body;

a first fuel pump mounted on the body;

a starter circuit including a second fuel pump mounted on the body, a first pulse passageway, having a beginning and an end, extending through the body to the second fuel pump, and a restriction within the first pulse passageway;

a second pulse passageway extending through the body to the first fuel pump;

a channel interconnecting the first and second pulse passageways; and a restriction jet within either the first pulse passageway, the second pulse passageway, or the channel interconnecting the first and second pulse passageways.

31. The carburetor in claim 30, wherein the restriction jet is within the first pulse passageway.

32. The carburetor in claim 30, wherein the restriction jet is within the second pulse passageway.

33. The carburetor in claim 30, wherein the restriction jet is within the channel interconnecting the first and second pulse passageways.

34. A method of enriching the air-fuel mixture in a carburetor mounted to an engine, having a crankcase, during start-up of the engine comprising the steps of:

transmitting low frequency pulses from an engine's crankcase to an auxiliary fuel pump mounted on a carburetor body;

preventing high frequency pulses from being transmitted from the engine's crankcase to the auxiliary fuel pump;

drawing fuel from a metering chamber in the carburetor into a pumping chamber of the auxiliary fuel pump when pulses are transmitted to the auxiliary fuel pump; and discharging the fuel in the pumping chamber into a throttling bore in the carburetor body when pulses are transmitted are transmitted to the auxiliary fuel pump.

35. The method of claim 34 further comprising the steps of:

rotating a throttle valve shaft in the carburetor past wide open throttle to a preset position wherein a hole drilled through the throttle valve shaft is aligned with the pulse passage way to open the pulse passageway; and reverse rotating the throttle valve shaft to close the pulse passageway.

36. The method of claim 34, further comprising the step of metering the fuel into the auxiliary pump.

37. The method of claim 34, further comprising the step of metering the fuel out of the auxiliary pump.

38. The method of claim 34, further comprising the step of priming the auxiliary fuel pump with fuel.

39. The method of claim 34, further comprising the step of purging air from the metering chamber in the carburetor body.

* * * * *